United States Patent [19]

Murphy et al.

[11] Patent Number: 4,776,389

[45] Date of Patent: Oct. 11, 1988

[54] METHOD AND APPARATUS FOR EVACUATING AND FILLING HEAT PIPES AND SIMILAR CLOSED VESSELS

[75] Inventors: John E. Murphy, Los Angeles; Joseph E. Snyder, El Segundo; William T. Gardner, Los Angeles, all of Calif.

[73] Assignee: Hughes Aircraft Company, Los Angeles, Calif.

[21] Appl. No.: 825,127

[22] Filed: Feb. 3, 1986

[51] Int. Cl.[4] ..... F28D 15/02

[52] U.S. Cl. ..... 165/104.27; 165/71; 251/351

[58] Field of Search ..... 165/104.27, 71; 251/351

[56] References Cited

U.S. PATENT DOCUMENTS 4,341,000 7/1982 Stockman .
4,470,577 9/1984 Warwick ..... 251/351
4,603,796 8/1986 Joly et al. ..... 251/339

FOREIGN PATENT DOCUMENTS 985909 7/1951 France .
2564567 11/1985 France .
1213872 4/1966 Fed. Rep. of Germany ..... 165/104.27
58-88594 5/1983 Japan .

*Primary Examiner*—Albert W. Davis, Jr.
*Attorney, Agent, or Firm*—Leonard A. Alkov; A. W. Karambelas

[57] ABSTRACT

A table carries guides for receiving and guiding a heat pipe. The heat pipe has a fill port which contains a valve. The heat pipe is thrust against the seal face of a block for evacuating and filling the fluid chamber of the heat pipe. A hex driver passes through the block and engages the valve to open and close the valve while the fill port is sealed from the atmosphere.

1 Claim, 2 Drawing Sheets

METHOD AND APPARATUS FOR EVACUATING AND FILLING HEAT PIPES AND SIMILAR CLOSED VESSELS

BACKGROUND

This invention is directed to a method and apparatus for evacuating and filling heat pipes and similar closed vessels where the vessel has an opening with a valve therein which can be sealed against the apparatus while the vessel is evacuated and filled. Thereafter, the valve is closed while the opening is still sealed.

Heat pipes are closed vessels having a chamber therein. There is a heat input portion and a heat output portion of the heat pipe. Fluid in the chamber circulates and principally transfers heat by the heat of vaporization and condensation, coupled with mass transfer of vapor and liquid. The heat pipe utilizes evaporation and condensation of the fluid and achieves efficient heat transfer by mass transfer of the fluid. The heat pipe working fluid may be water, ammonia, methanol or other alcohols, or halogenated hydrocarbons, such as freon. The particular working fluid and the quantity of that working fluid which relates to the working pressure of the heat pipe are chosen in accordance with the range of temperatures expected to be encountered in operation of the heat pipe in accordance with material compatibility properties.

The working fluid in the chamber of the heat pipe is thus critical with respect to both quantity and quality of the fluid fill or "charge". To achieve the correct fluid fill or "charge", present heat pipes are provided during their manufacture with an externally protruding filling tube which is in communication with the chamber. After the physical manufacturing is completed, the heat pipe is processed by charging it with the correct fluid. First, the fill tube is connected to a vacuum source to evacuate the original materials from the heat pipe chamber and, thereafter, the proper amount of the selected working fluid is charged through this fill tube. After filling, the tube is closed by crimping and welding to maintain the closed integrity of the heat pipe chamber. This method of charging the heat pipe is time-consuming, is a process which must be critically performed in order to be successful, is permanent, is difficult to achieve repeatability, and cannot be used for a recessed fill port. Therefore, there is need for a method and apparatus for evacuating and filling heat pipes and similar closed vessels so that the evacuation, filling and sealing of the vessels are quickly and reliably accomplished.

SUMMARY

In order to aid in the understanding of this invention, it can be stated in essentially summary form that it is directed to a method and apparatus for evacuating and filling heat pipes and similar closed vessels. The filling apparatus has an external seal against which the filling port of the heat pipe is clamped. The method includes the evacuating and filling of the heat pipe while the port is clamped against the seal. The heat pipe is provided with an internal valve in its filling port, and the valve is closed through the filling passage while the heat pipe remains sealed to the filling apparatus.

It is, thus, a purpose and advantage of this invention to provide a heat pipe design which does not require an external supplementary filling tube, but instead has a filling port with an internal valve therein so that the valve can be closed for sealing with no external protrusion from the heat pipe structure.

It is another purpose and advantage of this invention to provide a method and apparatus for charging heat pipes which is suitable for high volume processing, wherein evacuation, filling and closing of the heat pipe can be readily accomplished with the heat pipe clamped in a single fixture location.

It is another purpose and advantage of this invention to provide a heat pipe which has a reopenable valve in its filling port so that the heat pipe can be repaired and reprocessed repeatedly, as required, without the need to open or replace a crimped tube.

It is another purpose and advantage of this invention to provide a heat pipe of simplified design having the filling port as part of the inherent structure of the heat pipe, thus reducing the cost of the heat pipe and the cost of the heat pipe filling steps due to the readily manufactured design and the ease and integrity of the filling process.

Other purposes and advantages of this invention will become apparent from a study of the following portion of this specification, the claims and the attached drawings.

DESCRIPTION OF THE PREFERRED EMBODIMENT

Figure 1:
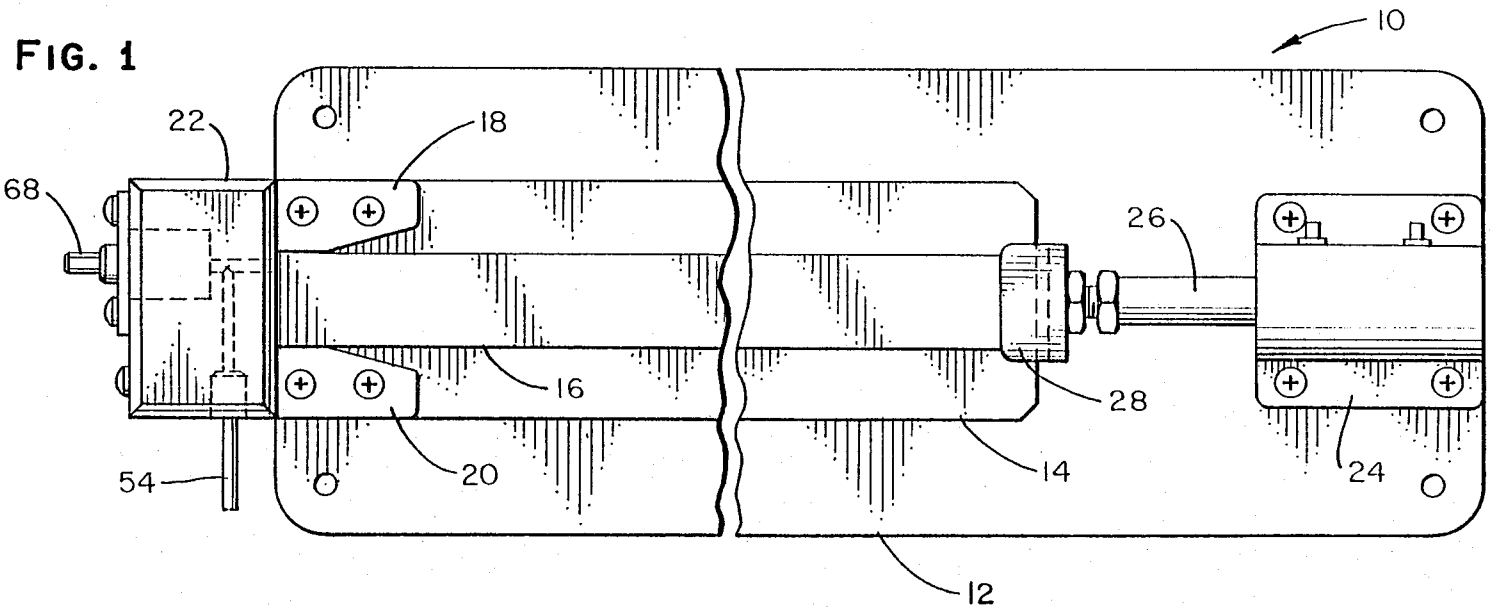
FIG. 1 is a plan view of the apparatus of this invention, which holds a heat pipe in position during the filling process.
Figure 2:
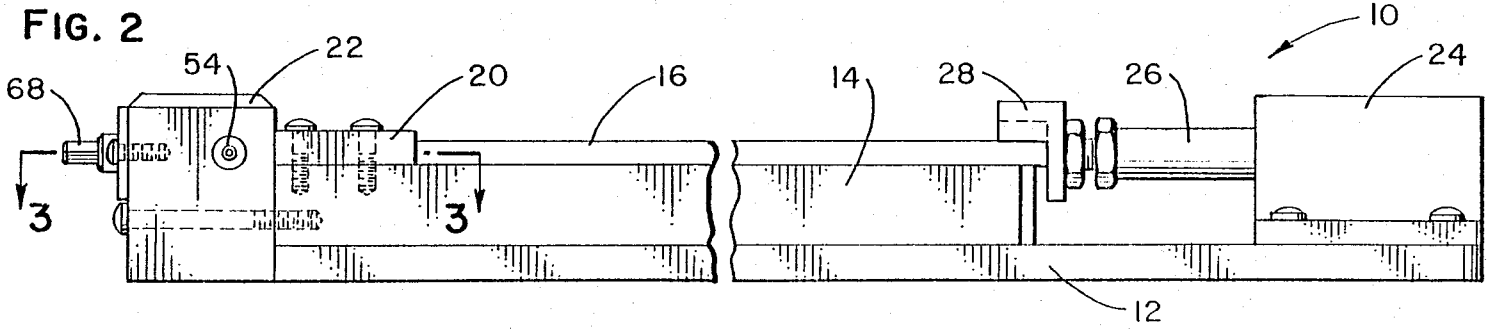
FIG. 2 is a side-elevational view of the apparatus shown in FIG. 1.

The apparatus for evacuating and filling heat pipes and similar closed vessels in accordance with this invention is generally indicated at 10 in FIGS. 1 and 2. The apparatus has a baseplate 12 upon which is secured table 14. Table 14 is for the support of a heat pipe 16 thereon. As is seen in FIGS. 1 and 2, the heat pipe 16 is a long, narrow, rectangular structure which lies upon the top of table 14 and extends somewhat beyond the right end thereof. Guides 18 and 20 are attached to the top of the table 14 at the left end thereof and are spaced apart to receive the end of heat pipe 16 therebetween. Block 22 is secured on the left end of table 14 and extends thereabove to act as a stop for the left end of heat pipe 16, among other functions. Clamp 24 is mounted on the right end of baseplate 12 and has thrust bar 26 extending therefrom. Thrust finger 28 is mounted on the end of the thrust bar 26 to engage the right end of the heat pipe 16. When clamp 24 is actuated, it applies a leftward force which holds the left end of heat pipe 16 against the stop face 30 (see FIG. 3) of block 22. For convenience of illustration, clamp 24 is shown as a cylinder and piston clamp, for which the thrust bar 26 is the piston rod. By controlling the fluid pressures against the clamp piston (not shown), the amount of force on the heat pipe 16 can be controlled. Other types of clamping structures, such as toggle, lever arm and spring clamps, could alternatively be employed.

Figure 3:
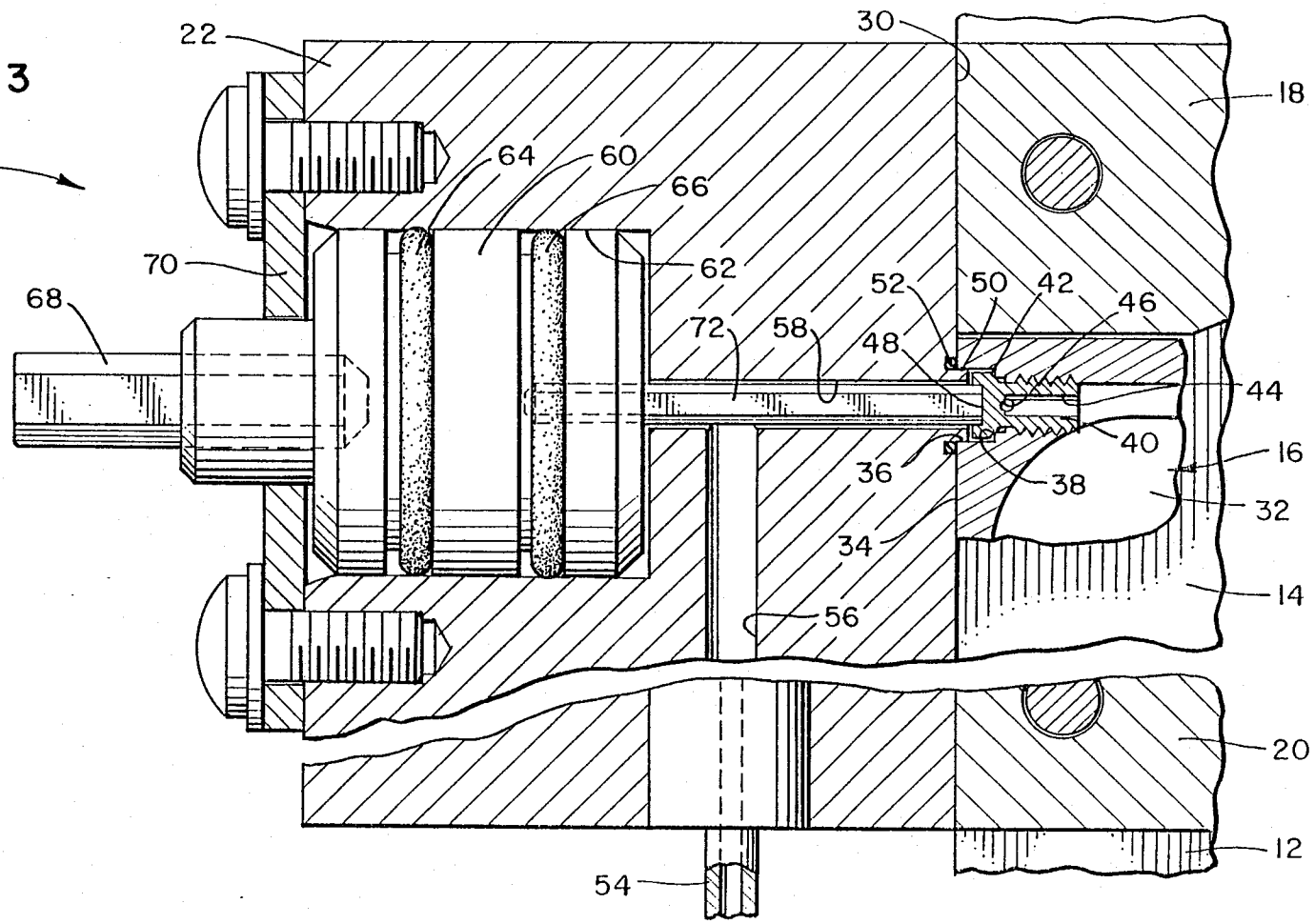
FIG. 3 is an enlarged section taken generally along the line 3—3 of FIG. 2, with parts broken away.

A portion of the heat pipe 16 is shown in more detail in FIG. 3. Heat pipe 16 is a rectangular structure having a chamber 32 therein. The chamber 22 extends substantially the length of the heat pipe 16 and may have wicks or other structures therein to aid in fluid flow by capillary action. The left end face 34 of heat pipe 16 is planar to lie against the planar stop face 30 when thrust into that position by the clamp 24. Fill port 36 extends from the face 34 into chamber 32, past seat 38. Toward the interior of the heat pipe 16 from the seat 38, the port 36 is threaded to receive threaded valve member 40. Valve member 40 has a shoulder 42 thereon which serves as a valve disc and which engages against seat 38 to form a cold weld thereagainst when the valve member 40 is fully screwed down into the port 36. Valve member 40 has axial bore 44 extending from chamber 32 to cross bores 46, which are just beyond shoulder 42 in the direction of chamber 32. These bores 44 and 46 permit fluid flow between the chamber 32 and fill port 36 when the valve member 40 is off the seat 38, without the requirement of fluid flow past the threads of the valve member 40. At its outer face, valve member 40 is provided with a hexagonal recess 48.

The guides 18 and 20 are positioned so that when the heat pipe 16 is placed therebetween, the fill port 36 receives nose 50 extending from the stop face 30. It will be noted that the outer end of the valve member 40 is recessed from the stop face 30 and O-ring 52 seals around the fill port 36. Process tube 54 is connected through a vacuum control valve (not shown) to a vacuum source (not shown) and is connected through a fill fluid control valve (not shown) to a source of heat pipe filling fluid (not shown). Process tube 54 communicates with passage 56 which, in turn, communicates with passage 58 which opens through nose 50 to the fill port 36. When the valve member 40 is off of its seat 38, process tube 54 is connected to the interior chamber 32 of heat pipe 16. When the valves on the process tube 54 are controlled, the chamber is first evacuated and then a preselected amount of the desired heat pipe fluid is introduced into the chamber 32.

Piston 60 is mounted in cylindrical chamber 62 and is sealed therein by means of O-rings 64 and 66. It is rotatable in its chamber 62 by means of hex shank 68 which extends leftward, exteriorly of block 22. The piston 60 is maintained in its chamber 62 by means of cover plate 70 screwed on the left end of block 22. Hex driver 72 engages a hexagonal recess in the right end of piston 60, extends through passage 58, is spaced inwardly from the sidewalls thereof, and engages the hex recess 48 in valve member 40. Thus, by use of a hex wrench (not shown) to rotate the hex shank 68, hex driver 72 rotates valve member 40 in the port 36. In this way, the valve member 40 is rotated to screw down to a closed position with its shoulder 42 against seat 38 when filling is complete. Hence, valve closing is accomplished while the area of the fill port 36 is subjected to the proper pressure of the fill fluid, and is protected from the ambient air. From the foregoing it will be readily apparent that the heat pipe 16 can be quickly put in place, evacuated, filled with the proper amount of the proper fluid, and its chamber 32 closed without changing stations or connections. The heat pipe 16 is quickly locked against a leak-tight seal 52 during all of the steps of processing, i.e., the evacuation, filling and closing of the fill port 36. Each step is completed while the heat pipe 16 is subjected to the proper environment. Because these steps are accomplished at the same station, each step can be more quickly and reliably accomplished.

Furthermore, it will be understood that the heat pipe fill port 36 is integral in the design of the heat pipe 16 and it is not a supplemental structure. The employment of a valve member 40 has an additional advantage in that the heat pipe 16 can be reprocessed, should for some reason there be improper fluid in the heat pipe 16. By returning the heat pipe 16 to its filling apparatus 10, the valve member 40 can be opened, the chamber 32 of the heat pipe 16 evacuated, and the new fluid installed. Thus, there is an easily managed way of reprocessing such heat pipes.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. An elongated heat pipe comprising:

a metal wall defining a closed heat pipe chamber, a substantially planar face on said wall;

a passage extending through said heat pipe wall to provide access to said chamber in said heat pipe to provide a filling port for said heat pipe, said passage having a counter bore therein into said heat pipe from said planar face, a threaded section recessed below said planar face; and valve means in said passage for selectively closing off said passage, said valve means including a substantially square seat in said recess between said threaded section and said counter bore, said valve means including a metal valve member having a threaded end threaded into said passage, said valve member having a conical shoulder configured to sealingly engage on said valve seat in said valve passage, a non-round receptacle in said metal valve member configured for engagement by a corresponding non-round driver to rotate said valve member with respect to said heat pipe so that said valve member can be screwed into said passage to forcibly engage said shoulder on said valve seat in metal-to-metal engagement to close said passage, said valve member having a bore therethrough from said threaded end terminating on the side of said shoulder toward said threaded end, said valve member when closing said passage being positioned within said passage recessed from said external surface so as to provide a flush surface on said face for permitting evacuation of said chamber and filling of said chamber with a selected amount of heat pipe fluid without valve structure extending beyond said face.

* * * * *